US005700202A

United States Patent [19]

Tucker

[11] Patent Number: 5,700,202

[45] Date of Patent: Dec. 23, 1997

[54] GOLF SWING TRAINING DEVICE

[76] Inventor: Edwin L. Tucker, 4801 Laurel Oaks Dr., Greensboro, N.C. 27406

[21] Appl. No.: 699,575

[22] Filed: Aug. 19, 1996

[51] Int. Cl.[6] ..... A63B 69/36

[52] U.S. Cl. ..... 473/142; 473/147

[58] Field of Search ..... 473/139, 142, 473/147; 273/413

[56] References Cited

U.S. PATENT DOCUMENTS

| | | | |
|---|---|---|---|
| 1,528,909 | 3/1925 | Bullard | 473/147 X |
| 3,051,491 | 8/1962 | Cabot | 473/147 |
| 3,826,439 | 7/1974 | Moon | 473/142 |
| 3,888,010 | 6/1975 | Hyde et al. | 473/142 U X |
| 4,927,154 | 5/1990 | Boyer et al. | 473/142 |

OTHER PUBLICATIONS

Drawing of conventional chalk line reel. No Publication Date.

*Primary Examiner*—William H. Grieb

[57] ABSTRACT

A golf swing training device is provided herein. A ball is connected to a line wound about a reel, and one or more weights are slidably positioned upon the line. When the ball is struck, its inertia strips line from the reel, and the line trails behind the ball in flight. Simultaneously, the weights are carried along by the line, and these weights exert a downward force on the line, thereby dampening the flight of the struck bail and forcing the ball back toward the ground. Also, when the ball's trajectory curves upward, the friction between the weight and the line increases, thus decelerating the ball. After the ball strikes the ground, the ball can be retrieved by manually rotating the reel in the preferred embodiment.

19 Claims, 4 Drawing Sheets

GOLF SWING TRAINING DEVICE

BACKGROUND OF THE INVENTION

1. Field of the Invention

This invention pertains generally to the field of golf, and specifically to a device for perfecting a golf swing.

2. Description of the Prior Art And Objectives of the Invention

It is well known in the sport of golf that a player can perfect his or her swing only by rigorous practice. Golfers who live near golf courses or driving ranges can readily travel to those facilities to practice their swings. However, golfers who live far from such facilities face the dilemma of either traveling a great distance, or attempting to practice at home. Obviously, urban golfers cannot practice in their backyards without creating a risk of damage or injury to adjacent dwellings and neighbors.

The prior art teaches practicing with lightweight, short flight plastic balls. However, such plastic balls do not handle or "feel" the same as real golf balls. Consequently, practicing with plastic balls is not as productive as practicing with real golf balls. The prior art also teaches hitting real golf balls into nets or screens. However, such nets are cumbersome to store and to set up, and can become unsightly if left exposed to the elements. Thus, the prior art suffers a shortcoming in that urban golfers wishing to practice at home must either use a plastic ball, or store and set up a cumbersome net. A need exists for a portable, compact device that allows an urban golfer to practice at home with real balls without endangering his neighbors and without using cumbersome nets and screens.

These shortcomings of the prior art motivated the current invention. Thus, one objective of this invention is to provide a device that allows a golfer effectively to practice his or her swing without leaving home.

It is still another objective to provide a compact, portable device that allows a golfer to practice at home with real golf balls without imposing a risk of property damage or personal injury upon adjacent dwellings or neighbors.

It is another objective to provide a flight retardation device that prevents the ball from traveling a great distance after being struck, yet allows the ball to travel on a realistic initial trajectory, thus permitting the golfer to judge how well the ball has been hit.

It is yet another objective to provide a device that uses a reel, a line, and a weight to dampen the flight of a golf ball.

It is yet still another objective to provide a device that allows a golfer to adjust the weight positioned on the attached line depending on the club used.

It is also an objective to provide a device that, in a preferred embodiment, allows a golfer to retrieve a ball by manually winding an attached reel.

It is still another objective to provide a device that, in an alternate embodiment, allows a golfer to retrieve a struck ball by activating a battery-powered motor attached to a reel.

Various other objectives and advantages of the present invention will become apparent to those skilled in the art as a more detailed description of the embodiments is presented below.

SUMMARY OF THE INVENTION

The aforesaid objectives can be realized by a device for retarding the flight of a golf ball. The device includes a golf ball attached to a line, several weights slidably positioned on the line, and a reel for storing, feeding, and retrieving the line. The reel is situated within a housing, which in turn includes a weight retainer for storing the several weights employed.

The device relies upon two physical forces to arrest the flight of a struck ball. First, gravity indirectly retards the flight of the ball by pulling the weights downward. Second, friction between the weights and the line decelerates the ball.

A golfer uses the device by stripping about 10 yards of line from the reel, anchoring the reel, removing one or more weights from the weight retainer, positioning the weights on the stripped line, addressing the ball, and striking it. After traveling a short distance, the ball is pulled to the ground. The golfer can then retrieve the ball and strike it again. In the preferred embodiment, the golfer retrieves the line by manually rotating the reel. In the alternate embodiment, the golfer retrieves the line operating an electric motor connected to the reel.

The device also allows the golfer to adjust the amount of weight placed on the line to compensate for the various loft characteristics of different golf clubs. Depending on the loft of a given club, the golfer can effectively dampen the flight of the ball by placing more or less weight on the line.

DETAILED DESCRIPTION OF THE PREFERRED EMBODIMENTS AND OPERATION OF THE INVENTION

Figures 1, 4:
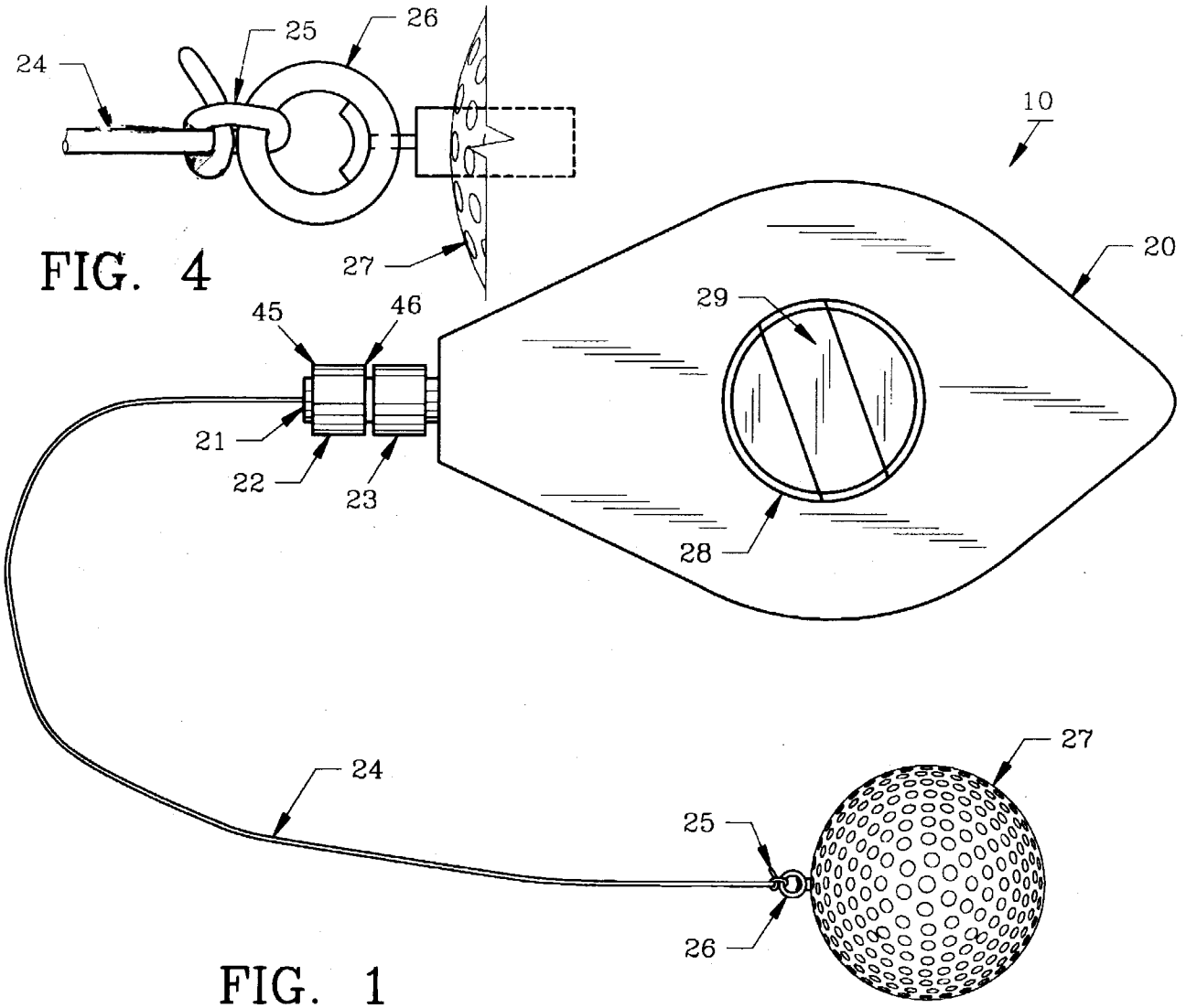
FIG. 1 shows a top plan view of the preferred embodiment of the invention.
FIG. 4 provides an enlarged view of the swivel connection between the line and the ball as shown in FIG. 1.

Turning now to the drawings, FIG. 1 provides a top plan view of the preferred form of the invention, which is denoted generally as golf swing training device 10. Housing 20 as illustrated is conventional and has been used in the carpentry trade for chalk boxes or chalk lines. However, housing 20 need not be the particular shape and configuration shown; other shapes are equally useful. Reel 28 is also conventional and is rotatably carried by housing 20. Handle 29 is pivotally attached to reel 28 to allow manual rotation of reel 28. Likewise, this rotation capability is conventional.

Ball 27 is swivelly attached to line 24 such that any axial rotation of ball 27 relative to line 24 does not twist or kink line 24. This swivel attachment is accomplished by swivel 26 and by knot 25, which are shown in greater detail in FIG. 4. Line 24 passes through weight retainer aperture 31 (shown in FIG. 6) into the interior of housing 20, where line is attached to reel 28. Weight retainer 21 is mounted to the front of housing 20, and allows for frictional engagement with weights 22 and 23 for selective retaining of the same. Weight 22 includes uniform ends 45 and 46.

Figure 2:
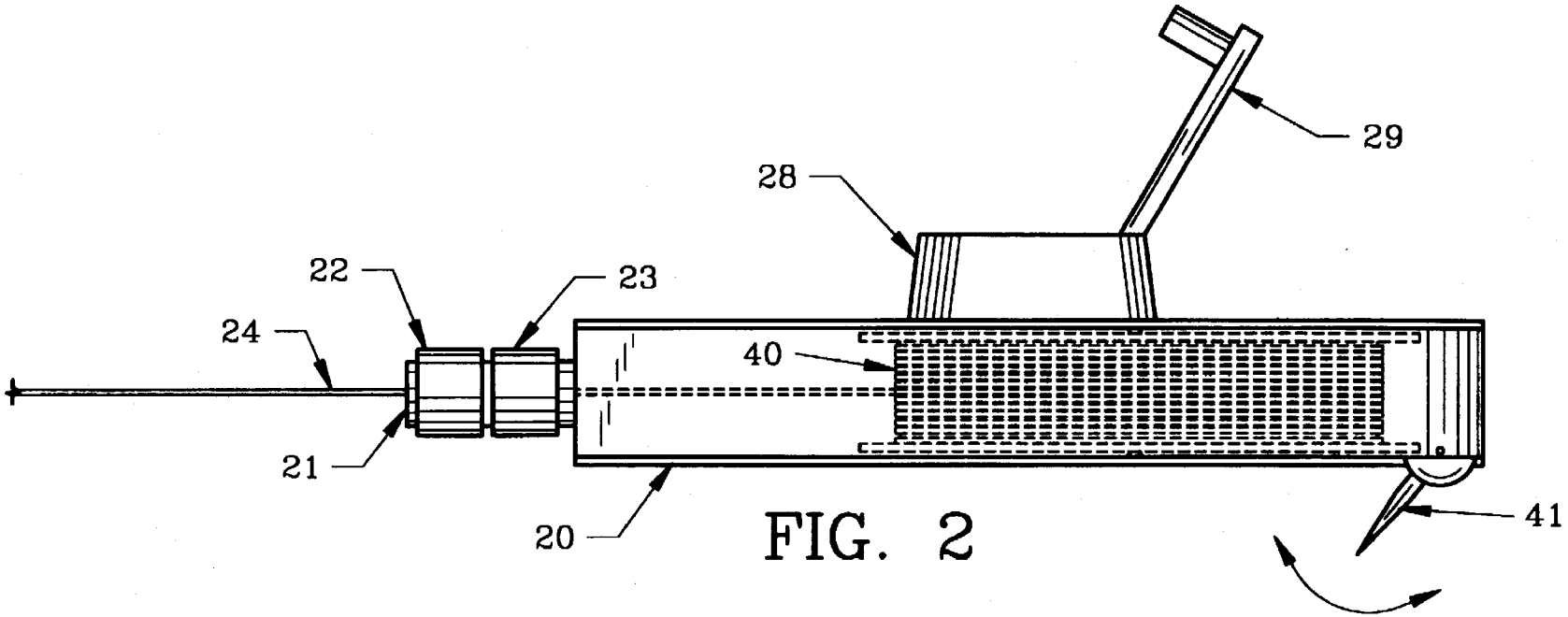
FIG. 2 illustrates a side elevational view of the device as shown in FIG. 1, with the spool and interior line shown in dashed outline.

FIG. 2 presents a side elevational view of the device as shown in FIG. 1. Weights 22 and 23 are shown frictionally positioned upon weight retainer 21, which can be formed from resilient material such as rubber or plastic. Line 24 passes through weight retainer aperture 31 into the interior of housing 20, where line 24 is wound about spool 40. Spool 40 is situated interiorly of housing 20, and is connected to reel 28. Handle 29 is shown pivoted upwardly from reel 28 to allow for manual rotation of reel 28, as is well known in the art. When handle 29 is rotated, spool 40 is rotated and line 24 is withdrawn into housing 20. Spool 40 could also be connected by a coiled spring (not shown) to housing 20. This arrangement would allow spool 40 to be spring-loaded by the flight of ball 27 when it is struck. Line 24 could then be retrieved by releasing spool 40 in much the same manner as a conventional coiled steel tape measure. Anchoring spike 41 is pivotally attached to housing 20 and is shown in an extended position. In its fully extended form, anchoring spike 41 is driven into the ground to stabilize housing 20 when in use.

Figures 3, 7:
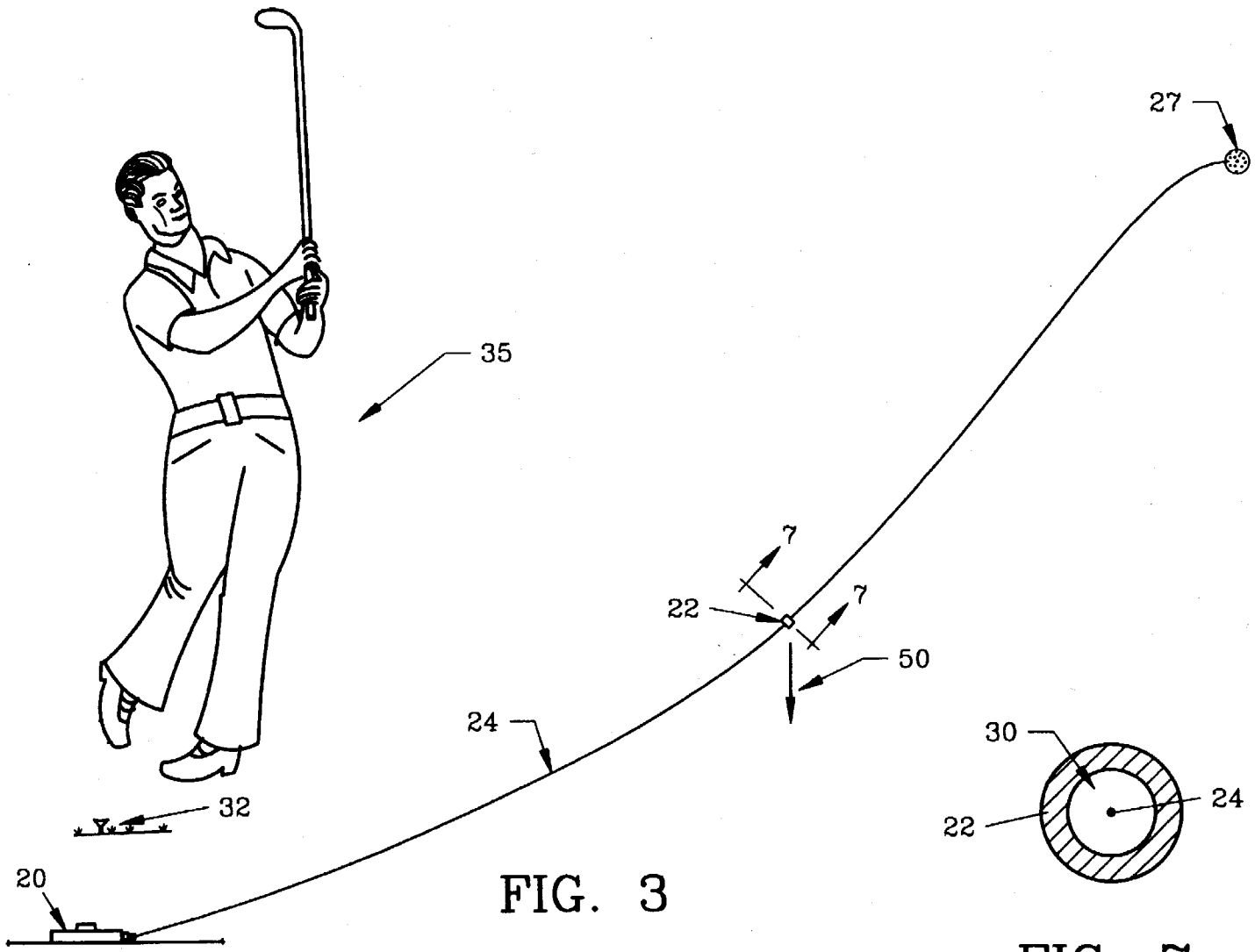
FIG. 3 depicts the invention in use by a golfer.
FIG. 7 shows a cross-sectional view of the device as shown in FIG. 3, taken along lines 7—7.

A typical use of the invention is depicted in FIG. 3. Golfer 35 has just struck ball 27 from tee 32. Ball 27 is shown traveling along its flight trajectory, stripping line 24 from housing 20. Line 24 trails behind ball 27 and slidably carries weight 22. While ball 27 maintains a flat trajectory, the friction between weight 22 and line 24 is slight. Thus, weight 22 does not substantially decelerate ball 27, but weight 22 does pull line 24 and ball 27 downward. However, once ball 27 assumes an upward trajectory, the friction between weight 22 and line 24 increases, and weight 22 then decelerates ball 27.

The preferred method of using the device has golfer 35 stripping about 10 yards of line 24 from reel 28. Then golfer 35 secures housing 20 either by anchoring it in the earth with spike 41, or by placing it in a trousers pocket (not shown). Next, golfer 35 places ball 27 on tee 32 and strikes ball 27. After ball 27 comes to rest, golfer 35 retrieves it one of two ways. In the preferred embodiment, golfer 35 retrieves line 24 by manually rotating spool 40 with handle 29. In an alternate embodiment, golfer 35 retrieves line 24 by electrically rotating spool 40 with motor 60. A coil spring as conventionally used in tape measures may also be positioned on the reel in place of an electric motor and can be used as a means to rewind line 24. After retrieving ball 27, golfer 35 is ready to repeat the method for another practice stroke.

To practice with clubs having greater loft, such as sand wedges or 9-irons, golfer 35 places only weight 22 on line 24. Ball 27 when struck by such clubs will have a sharply upward-curving trajectory, which will cause increased friction between weight 22 and line 24. This increased friction will decelerate ball 27 quickly, and the additional mass of weight 23 is not needed.

To practice with clubs having lesser loft, such as woods or low irons, golfer 35 places both weights 22 and 23 on line 24. Ball 27 when struck by such clubs will have a longer, flatter trajectory. A flat trajectory results in little friction between weights 22 and 23, and line 24. Less friction means slower deceleration of ball 27, and gravity, as represented by vector 50, must play a greater role in dampening the flight of ball 27. Thus, the added mass of weight 23 is necessary to increase the gravitational force acting on ball 27.

In FIG. 4, an expanded view of the swivel connection between line 24 and ball 27 is seen, with the portion of swivel 26 inside ball 27 shown in dashed outline. Knot 25 is formed of line 24 and passes through swivel 26. Swivel 26 is conventional and isolates ball 27 from line 24 such that any axial rotation of ball 27 relative to line 24 will not twist or kink line 24. This design is necessary because ball 27 will inevitably turn and twist after being struck. Swivel 26 prevents line 24 from becoming twisted after several practice strokes are applied.

Figure 5:
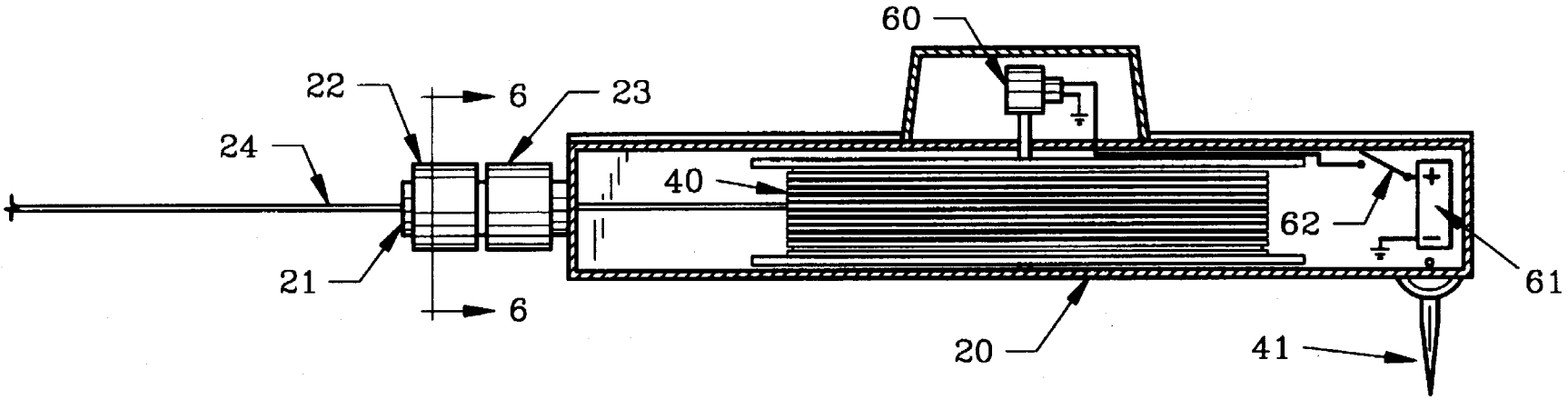
FIG. 5 features a schematic diagram of the circuit used to energize and control the electric motor in the alternate embodiment of the invention.

FIG. 5 shows the alternate embodiment of the invent ion, illustrating an electrical schematic of the power and control circuit for operating conventional motor 60, which can be used to rotate spool 40 automatically, as opposed to manually cranking handle 29. Motor 60 is powered by conventional battery 61, and is operated by closing conventional normally-open switch 62, which can be mounted on the exterior of housing 20 to allow golfer 35 to operate motor 60 by closing normally-open switch 62.

Figure 6:
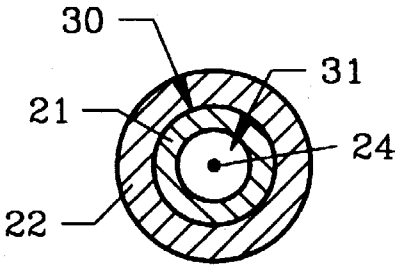
FIG. 6 demonstrates a cross-sectional view of the device as shown in FIG. 5, taken along lines 6—6.

A cross-sectional view of the device as shown in FIG. 5, taken along the line 6—6, is seen in FIG. 6. Weight 22 defines aperture 30, which allows weight 22 to frictionally engage weight retainer 21. The diameter of aperture 30 is slightly larger than the outside diameter of weight retainer 21 to allow frictional engagement therewith. Weight retainer 21 defines weight retainer aperture 31, through which line 24 passes.

FIG. 7 illustrates a cross-sectional view of the device as shown in FIG. 3, taken along the line 7—7. This view shows weight 22 when not frictionally engaged upon weight retainer 21. Weight 22 defines aperture 30, which allows line 24 to pass freely therethrough. Aperture 30 is of diameter sufficient to allow line 24 to pass axially therethrough with minimal friction. However, as ball 27 rises during its trajectory, weight 22 lifts, and friction between line 24 and weight 22 increases. This increased friction decelerates ball 27. Finally, it should be understood that although weight 22 is illustrated here, weight 23 has the same cross section and acts the same on line 24.

The examples and illustrations provided above are for explanatory purposes only, and do not limit the scope of the claims appended below.

I claim:

1. A device to retard the flight of a ball, said device comprising:

(a) a ball;

(b) a line, said line attached to said ball;

(c) a weight, said weight slidably positioned on said line, said weight having mass sufficient to dampen substantially the flight of said ball;

(d) a reel, said line connected to said reel; and (e) a weight retainer, said weight retainer connected to said reel, said weight retainer defining an aperture, said line passing through said weight retainer aperture.

2. The device of claim 1 wherein said ball comprises a golf ball.

3. The device of claim 1 wherein said reel comprises a spool, and a handle pivotally attached to said spool.

4. The device of claim 3 wherein said weight has two uniform ends.

5. The device of claim 1 further comprising a motor, said motor connected to said reel to allow said motor to withdraw said line, and a switch, said switch connected to said motor for controlling the same.

6. The device of claim 5 wherein said motor comprises a battery powered electric motor.

7. A golf ball flight retardation device, comprising:

(a) a golf ball;

(b) a line, said line attached to said golf ball;

(c) a first weight, said weight defining an aperture, said line passing through said aperture;

(d) a reel, said line attached to said reel; and (e) a weight retainer attached to said reel, said weight retainer defining an aperture, said line passing through said weight retainer aperture.

8. The device of claim 7 wherein said reel comprises a spool, and a handle, said handle to allow rotation of said spool to withdraw said line.

9. The device of claim 7 further comprising a means to rewind said line, said rewinding means attached to said reel, said rewinding means for withdrawing said line.

10. The device of claim 9 wherein said rewinding means comprises an electric motor.

11. The device of claim 7 further comprising a second weight, said second weight defining an aperture, said line passing through said second weight aperture.

12. The device of claim 7, wherein said weight retainer is formed of a resilient material.

13. The device of claim 12 wherein said resilient material is rubber.

14. The device of claim 7 wherein said first weight frictionally engages said weight retainer.

15. The device of claim 7 wherein said ball is swivelly attached to said line.

16. The device of claim 7 further comprising a swivel, said swivel attached to said ball.

17. The device of claim 7 wherein said reel comprises a spike, said spike attached to said reel, said spike for anchoring said reel.

18. A golf ball flight retardation device to train a golfer's swing, comprising:

(a) golf ball;

(b) a line, said line swivelly attached to said golf ball;

(c) a weight, said weight defining an aperture, said line passing through said aperture;

(d) a reel, said line attached to said reel, said reel comprising an anchoring spike, said spike attached to said reel; and (e) a weight retainer, said weight retainer attached to said reel, said weight retainer defining an aperture, said line passing through said weight retainer aperture, said weight retainer for selectively and frictionally engaging aid weight for storage thereof.

19. The device of claim 18 further comprising a motor, said motor connected to said reel to allow said motor to withdraw said line, and a switch, said switch connected to said motor to control the operation thereof.

* * * * *